US010577804B1

(12) United States Patent
Waites et al.

(10) Patent No.: US 10,577,804 B1
(45) Date of Patent: Mar. 3, 2020

(54) FOOT TRACTION PANEL ASSEMBLY FOR STAIR TREADS, STEPS, AND WALKWAYS

(71) Applicants: Michael Waites, Eclectic, AL (US); George B. Waites, Jr., Fletcher, NC (US)

(72) Inventors: Michael Waites, Eclectic, AL (US); George B. Waites, Jr., Fletcher, NC (US)

( * ) Notice: Subject to any disclaimer, the term of this patent is extended or adjusted under 35 U.S.C. 154(b) by 0 days.

(21) Appl. No.: 16/113,648

(22) Filed: Aug. 27, 2018

Related U.S. Application Data

(60) Provisional application No. 62/550,136, filed on Aug. 25, 2017.

(51) Int. Cl.
*E04F 11/16* (2006.01)
*E04F 11/17* (2006.01)

(52) U.S. Cl.
CPC ..... *E04F 11/175* (2013.01)

(58) Field of Classification Search
CPC ..... E04G 21/30; E04F 11/17; E04F 11/104; E04F 11/16; E04F 11/1045; E04F 2011/1048; A47G 27/0287; E01C 11/24
See application file for complete search history.

(56) References Cited

U.S. PATENT DOCUMENTS 943,418 A * 12/1909 Kanski ..... E04F 11/16 280/169
1,340,243 A * 5/1920 Oliver ..... E04F 11/16 182/228.2
1,359,978 A * 11/1920 Folin ..... E04B 1/4107 256/65.02
1,660,769 A * 2/1928 Smith ..... E04F 11/163 404/20
2,106,399 A * 1/1938 Beaumont ..... B60R 3/00 52/177
4,361,614 A * 11/1982 Moffitt, Jr. ..... A47G 27/0212 156/250
4,998,391 A * 3/1991 Connew ..... E04F 11/166 52/179
5,103,608 A * 4/1992 Andreo ..... E04F 11/166 52/179
5,323,575 A * 6/1994 Yeh ..... E04F 21/1844 52/177
5,342,141 A * 8/1994 Close ..... E01C 5/001 404/28
5,587,218 A * 12/1996 Betz ..... A47G 27/0293 15/215
5,653,071 A * 8/1997 Iwami ..... E01C 11/24 52/177
6,082,061 A * 7/2000 Ryan ..... B29C 45/14 52/182

(Continued)

*Primary Examiner* — Gisele D Ford
(74) *Attorney, Agent, or Firm* — Schwartz Law Firm, P.C.

(57) ABSTRACT

A foot traction panel assembly includes a panel body having an exposed top surface, opposing longitudinal sides, and opposing lateral ends. The panel body defines a plurality of narrow slots extending between the opposing sides and opposing ends. A plurality of removable spiked inserts are adapted for being custom arranged adjacent selected slots of the panel body. Each of the spiked inserts has an elongated base and a series of spaced apart rigid spikes attached to the base. The spikes are configured to extend vertically above the top surface of the panel body.

20 Claims, 7 Drawing Sheets

(56) References Cited

U.S. PATENT DOCUMENTS

| | | | | |
|---|---|---|---|---|
| 6,352,757 | B1 * | 3/2002 | Kessler | A47L 23/24 15/215 |
| 6,537,642 | B1 * | 3/2003 | Jacquet | A47G 27/0418 15/215 |
| 7,344,334 | B2 * | 3/2008 | Thorkelson | E01C 5/18 404/28 |
| 8,333,042 | B2 * | 12/2012 | Frederiksen | E01C 5/226 52/177 |
| 8,967,904 | B1 * | 3/2015 | Bub | A61H 3/066 404/19 |
| 9,121,186 | B2 * | 9/2015 | Mensah | E04F 11/17 |
| 2002/0106480 | A1 * | 8/2002 | Vallieres | A47G 27/0287 428/99 |
| 2004/0074698 | A1 * | 4/2004 | Lawrence | A47G 27/0287 182/129 |
| 2006/0230693 | A1 * | 10/2006 | Giordano | E04G 21/30 52/182 |
| 2010/0223880 | A1 * | 9/2010 | Smith | E01C 5/223 52/778 |
| 2010/0251627 | A1 * | 10/2010 | Kay | E04F 11/166 52/28 |
| 2011/0183102 | A1 * | 7/2011 | Afolabi | A47L 23/266 428/83 |
| 2012/0000151 | A1 * | 1/2012 | Cromb | E04F 11/17 52/179 |
| 2014/0013681 | A1 * | 1/2014 | Disch | E04F 11/16 52/179 |

* cited by examiner

FOOT TRACTION PANEL ASSEMBLY FOR STAIR TREADS, STEPS, AND WALKWAYS

TECHNICAL FIELD AND BACKGROUND OF THE DISCLOSURE

The present disclosure relates broadly and generally to a foot traction panel assembly for stair treads, steps, and walkways, and method for enhancing adhesive friction of a user's bare or covered foot on an existing stair tread, step, or walkway. The exemplary assembly can be used all year to help prevent slips and falls especially in the winter ice and snow, and in the summer around water. In addition to adding traction on unfinished, slippery or dangerous surfaces, the exemplary assembly may protect bare feet from burning on sun-heated docks, piers, boat ramps, and other outdoor walkways. In one exemplary embodiment, the present assembly's open pattern construction may promote more effective heat dispersion allowing the assembly to cool quicker in a direct sun environment.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the invention or to imply that certain features are critical, essential, or even important to the structure or function of the invention. Rather, these terms are merely intended to highlight alternative or additional features that may or may not be utilized in a particular embodiment of the present invention.

According to one exemplary embodiment, the present disclosure comprises a foot traction panel assembly applicable for use on an existing stair tread, step, walkway, or other foot-contacting surface. The exemplary foot traction assembly is applicable for use on any wood, concrete, polymer, metal, or other surface. The present assembly comprises a panel body having an exposed top surface, opposing longitudinal sides, and opposing lateral ends. The panel body defines a plurality of narrow slots extending between the opposing sides and opposing ends. A plurality of removable spiked inserts are adapted for being custom arranged adjacent selected slots of the panel body. Each of the spiked inserts comprises an elongated base and a series of spaced apart rigid spikes attached to the base. The spikes are configured to extend vertically above the top surface of the panel body.

According to another exemplary embodiment, the rigid spikes and elongated base of each spiked insert are integrally formed together as a single homogenous unit.

According to another exemplary embodiment, each spiked insert comprises between 3-8 rigid spikes.

According to another exemplary embodiment, each rigid spike has a forward-pointing, generally V-shaped tip configuration.

According to another exemplary embodiment, the panel body defines between 4-8 narrow slots extending between the opposing sides and opposing ends.

According to another exemplary embodiment, the traction panel assembly comprises between 4-8 removable spiked inserts adapted for being custom arranged within selected 4-8 narrow slots of the panel body.

According to another exemplary embodiment, the panel body further defines a plurality of corner openings adapted for managing surface-water runoff.

According to another exemplary embodiment, the panel body has a low profile height of less than 0.5 inches.

According to another exemplary embodiment, the panel body has a chamfered front edge extending longitudinally between the opposing ends.

According to another exemplary embodiment, the traction panel assembly has a downwardly-turned lip formed along the front edge of the panel body.

According to another exemplary embodiment, a bottom of panel body comprises a plurality of integrally formed structural ribs.

According to another exemplary embodiment, the top surface of the panel body comprises an anti-slip surface texture.

According to another exemplary embodiment, the traction panel assembly comprises a plurality of fastener landings formed between adjacent slots of the panel body. The fastener landings have respective holes for receiving fasteners used to mount the traction panel assembly to an underlying surface.

In another exemplary embodiment, the traction panel assembly includes a panel body having an exposed top surface, opposing longitudinal sides, and opposing lateral ends. The panel body defines a plurality of narrow slots extending between the opposing sides and opposing ends. A plurality of removable spiked inserts are adapted for being custom arranged adjacent selected narrow slots of the panel body. Each of the spiked inserts comprises an elongated flat narrow base and a series of spaced apart rigid spikes attached to the base. The flat narrow base is slightly wider than the slot and adapted to reside beneath the panel body, such that the rigid spikes extend vertically upward through the slot and above the top surface of the panel body.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
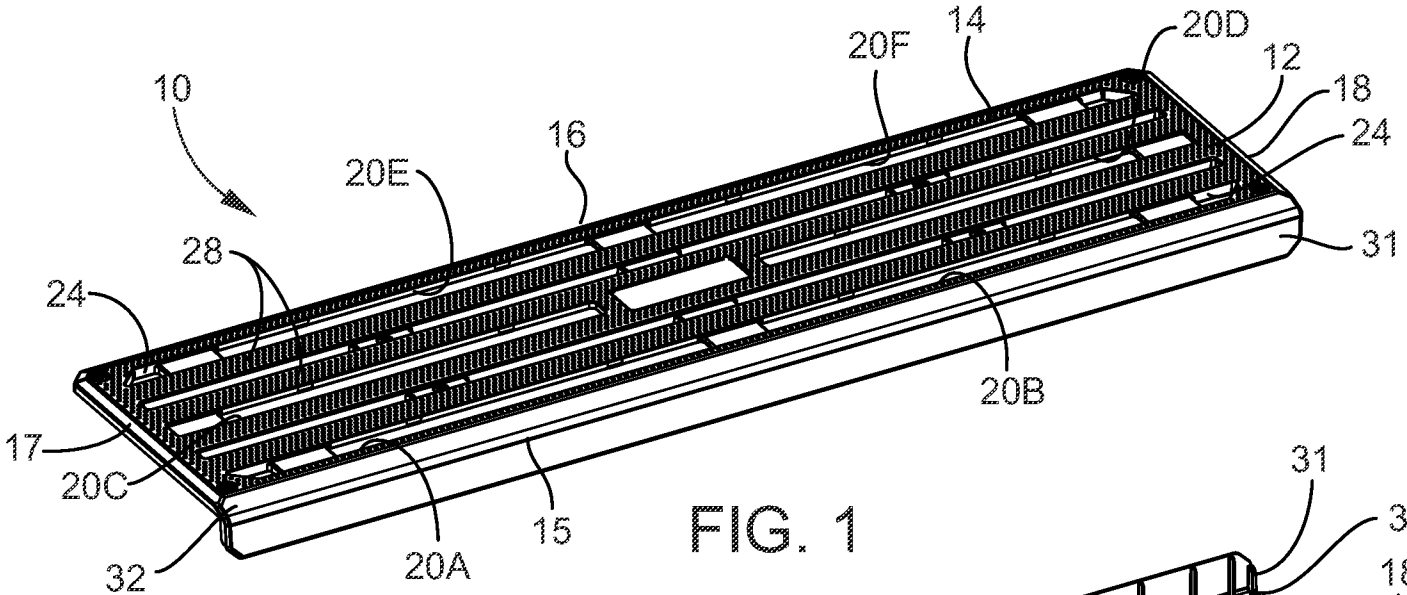
FIG. 1 is a perspective view of foot traction panel assembly according to one exemplary embodiment of the present disclosure.
Figure 4:
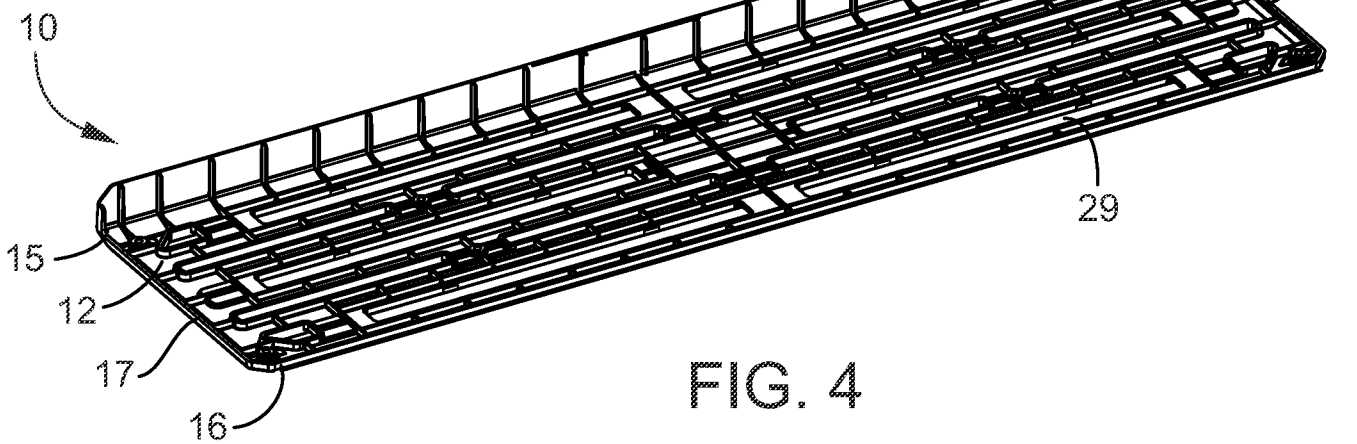
FIG. 4 is a further perspective of the exemplary traction panel assembly, and showing an underside arrangement of structural ribs and gussets
Figure 3:
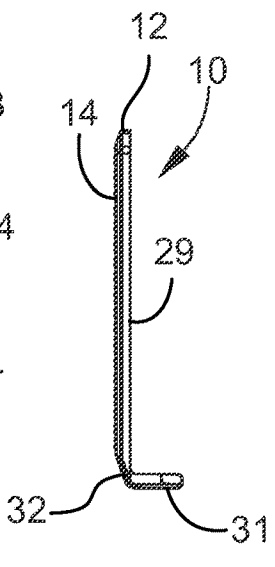
FIG. 3 is a side view of the exemplary traction panel assembly.

Referring now specifically to the drawings, a foot traction panel assembly according to one exemplary embodiment of the present disclosure is illustrated in FIG. 1, and shown generally at broad reference numeral 10. The exemplary traction panel assembly 10 is applicable for enhancing the adhesive friction (or "grip") of a user's bare or covered foot on an existing stair tread, step, or walkway. In alternative applications, the traction panel assembly 10 may be used on any generally flat surface to assist in the movement of rolling objects, such as carts, hand trucks, and other vehicles, or for any other purpose. The traction panel assembly may be injection molded as a single homogenous unit with a UV-resistant coating or UV stabilizer, and may be fabricated in a variety of neutral or vivid colors.

Figure 2:
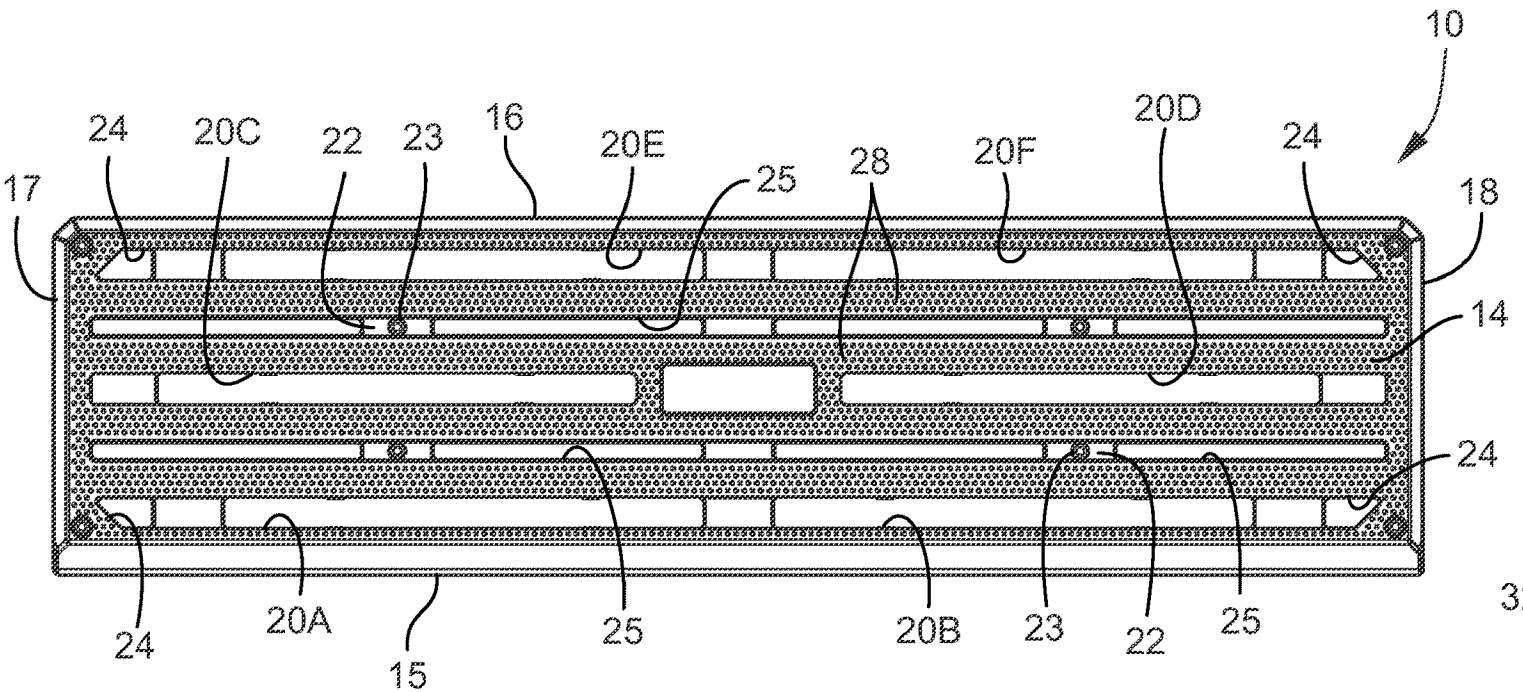
FIG. 2 is a top view of the exemplary traction panel assembly.
Figure 5:
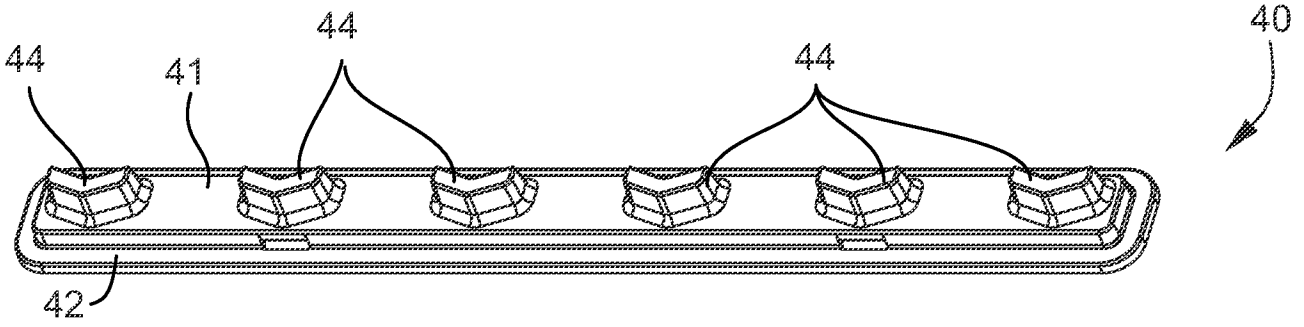
FIG. 5 is a perspective view of an exemplary spiked insert adapted to be removably located within a slot formed with the panel body.
Figure 6:
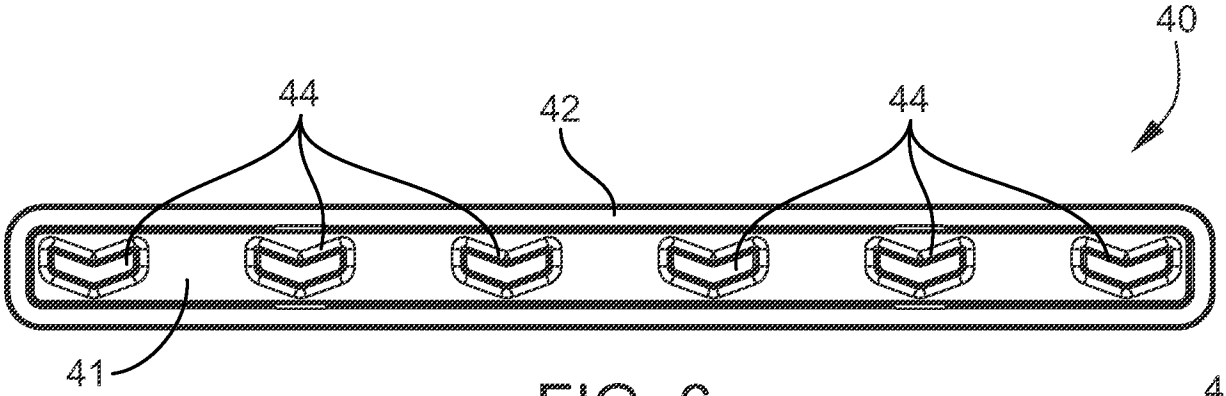
FIG. 6 is a top view of the exemplary spiked insert.
Figure 7:
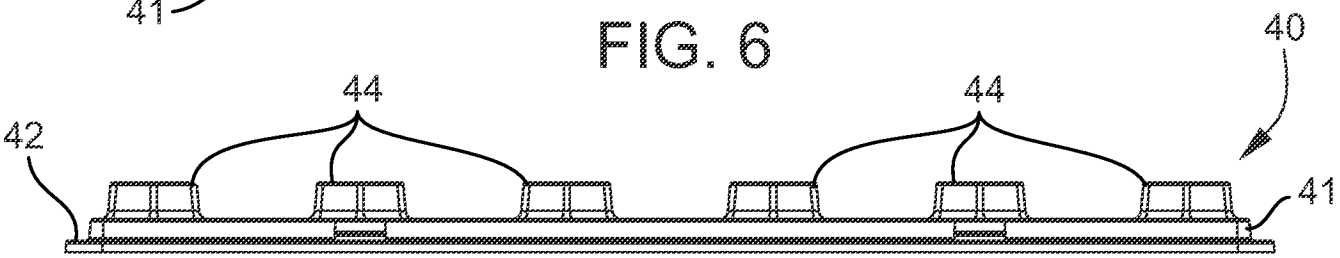
FIG. 7 is a side view of the exemplary spiked insert.
Figure 8:
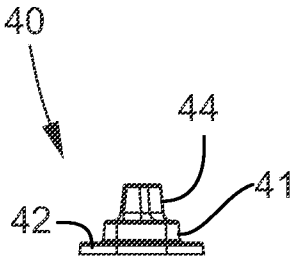
FIG. 8 is an end view of the exemplary spiked insert.
Figure 9:
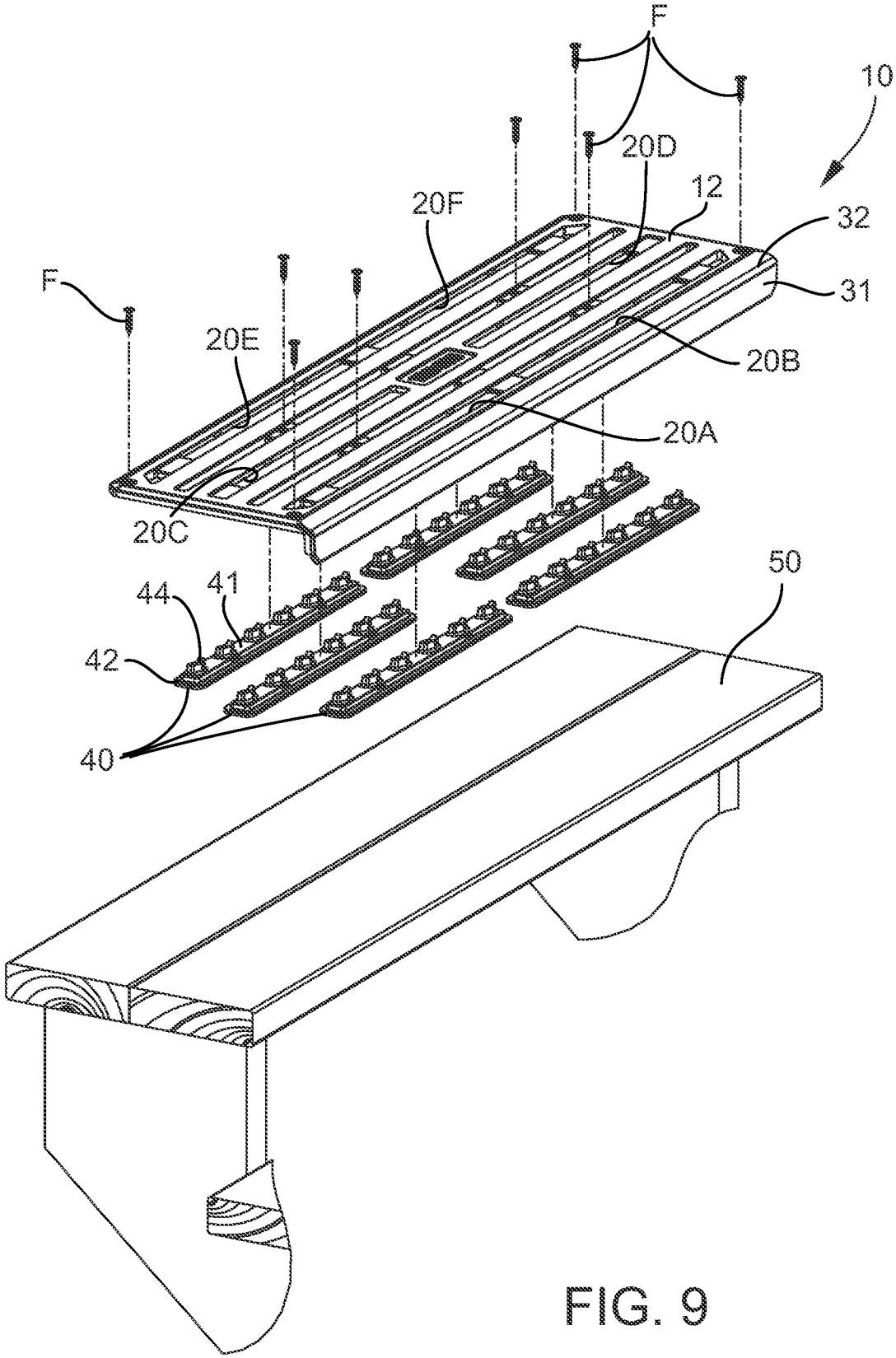
FIG. 9 is an exploded perspective view of the exemplary traction panel assembly applied to a wood stair tread.
Figure 11:
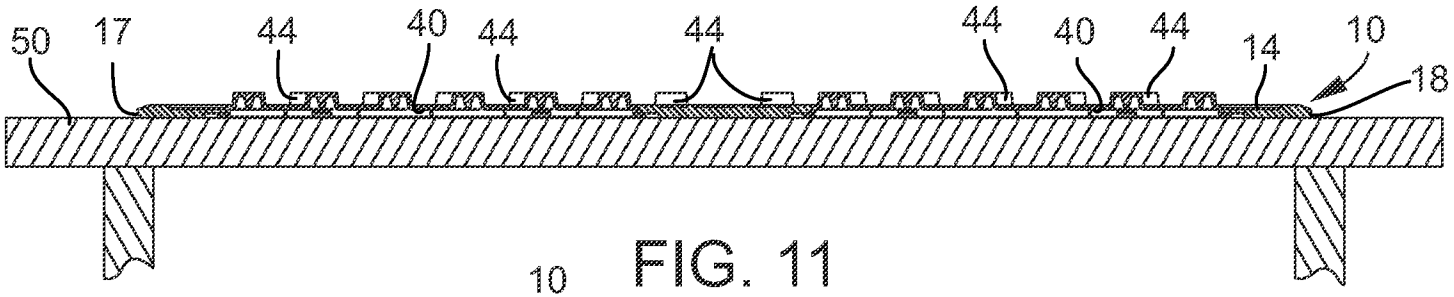
FIG. 11 is a cross-sectional view taken substantially along line 11-11 of FIG. 10.
Figure 12:
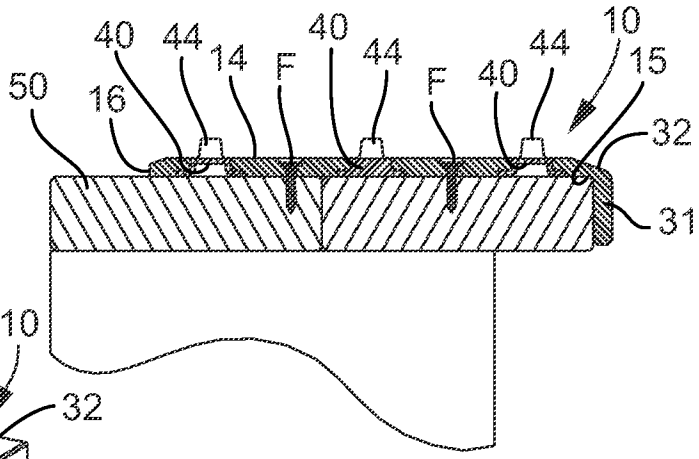
FIG. 12 is a further cross-sectional view taken substantially along line 12-12 of FIG. 10.
Figure 10:
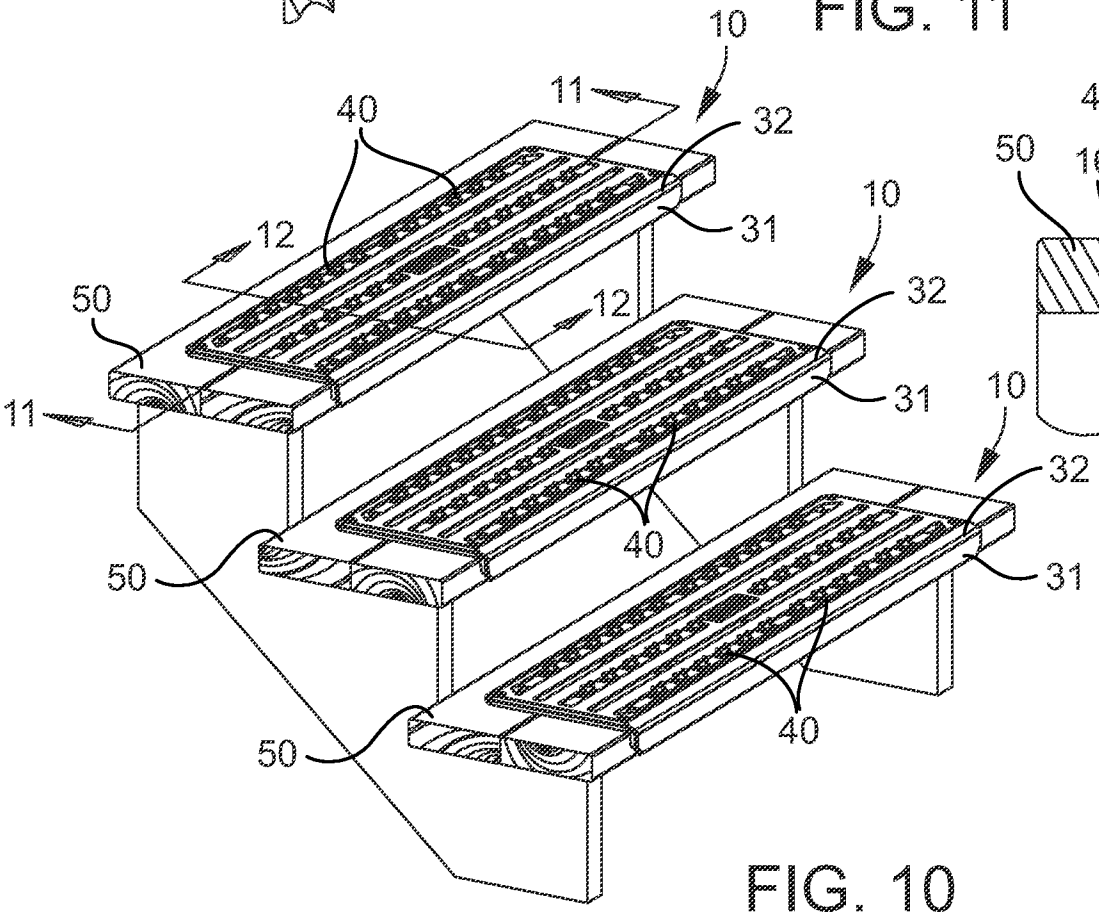
FIG. 10 is a further perspective view of exemplary traction panel assemblies applied respective stair treads of wood staircase.

Referring to FIGS. 1-4, the present assembly 10 comprises a low-profile panel body 12 having an exposed top surface 14, opposing longitudinal sides 15, 16, and opposing lateral ends 17, 18. The panel body 12 defines a number of strategically spaced narrow slots 20 (referenced generally at 20 and more specifically at 20A-20F) extending between the opposing sides 15, 16 and opposing ends 17, 18—each slot 20 having length and width dimensions identical to the other slots. In the present embodiment, panel body 12 defines two longitudinally aligned front slots 20A, 20B, two longitudinally aligned intermediate slots 20C, 20D, and two longitudinally aligned rear slots 20E, 20F. The pairs of front and rear slots 20A, 20B and 20E, 20F are laterally spaced apart from opposite sides 15, 16 of the panel body 12, respectively, while the intermediate slots 20C, 20D are located substantially along a longitudinal centerline of the panel body 12. As best shown in FIG. 2, the pairs of front and rear slots 20A, 20B and 20E, 20F are laterally spaced apart an equal distance from the pair of intermediate slots 20C, 20D. A number of fastener landings 22 are formed between adjacent slots 20 of the panel body 12, and define respective holes 23 for receiving fasteners "F" (FIG. 9) used to mount the traction panel assembly 10 to an underlying surface. Additional corner openings 24 and narrower slots 25 may be formed in the panel body 12 for added ventilation and to facilitate water runoff from the exposed top surface 14. The top surface 14 of panel body 12 may have an anti-slip texture 28 comprising a multiplicity of small raised bumps or the like. To increase its overall load strength and durability, the underside 29 of the panel body 12 (shown in FIG. 4) may incorporate an arrangement of integrally formed ribs and gussets.

When used on a stair tread, the traction panel assembly 10 may further comprise a downwardly-turned continuous lip 31 formed along a front edge 32 of the panel body 12 and designed to cover a nose of the tread. The front edge 32 of the panel body may also be chamfered between opposing ends 17, 18. In one exemplary embodiment, the profile (height) of the panel body 12 is about 0.38 inches, the length of the panel body 12 is approximately 36 inches, the width of panel body 12 is approximately 9.4 inches, and the height of the downwardly-turned lip 31 is approximately 1.38 inches. The width of each slot 20 is approximately 0.81 inches, and the length of each slot 20 is approximately 12.59 inches.

Referring to FIGS. 5-8, the exemplary traction panel assembly 10 further comprises a plurality of removable modular spiked inserts 40 designed to be custom arranged adjacent selected slots 20 of the panel body 12. Each spiked insert 40 has an elongated flat narrow base 41 comprising a thin peripheral flange 42 and a series of spaced apart rigid spikes 44 integrally formed with the base 41 along its length. The base flange 42 is slightly wider than the slot 20 and designed to reside directly beneath the panel body 12 when assembled, such that the rigid spikes 44 extend vertically upward through the slot 20 and above the exposed top surface 14 of the panel body 12. The portion of the base 41 extending above the flange 42 fits closely within the slot 20. In the exemplary embodiment, the rigid spikes 44 and elongated base 41 of each spiked insert 40 are integrally formed together (e.g., by injection molding) as a single homogenous unit. Each spiked insert 40 is identical to one another and may comprise between 3-8 rigid spikes 44—each rigid spike 44 having a forward-pointing, generally V-shaped tip configuration.

FIGS. 9-12 illustrate the exemplary traction panel assembly 10 applied to an existing wood stair tread 50. The spiked inserts 40 may be located in all slots 20 of the panel body 12, such as shown in FIGS. 9-12, or may be custom arranged within only selected slots 20. For example, for increased traction at the nose end of the stair tread 50 one or more spiked inserts 40 may be located within the front and/or intermediate slots 20A, 20B, 20C, 20D of the panel body 12. In another example, the spiked inserts 40 may be located only in slots 20A, 20C, 20E or 20B, 20D, 20F adjacent a selected end of the panel body 12. In yet another example, the spiked inserts 40 may be located only within the intermediate slots 20C, 20D. After determining the desired arrangement, the spiked inserts 40 are located within the selected slots 20 (from the underside of the panel body 12) and the panel body 12 laid over the stair tread 50 with the downwardly-turned lip 31 closely adjacent the nose of the tread 50. Once properly positioned, threaded fasteners "F" are inserted through respective fastener landings 22 of the panel body 12 and into the underlying stair tread 50 to removably mount the traction panel assembly 10 to the tread 50. The resulting assembly 10 may be especially applicable for improving foot traction in snow, ice, wet or other slippery conditions.

For each modular spiked insert 40, the length and width of the base 41 above the flange 42 may be only slightly less than the length and width of the slots 20. The total height of each rigid spike 44 above the base 41 is approximately 0.4 inches, the height of the base 41 above the flange 42 is approximately 0.23 inches, and the height of the flange 42 is approximately 0.13 inches. Additionally, the spiked inserts 40 may be injection molded with a plastic colorant (e.g., florescent orange or safety yellow) for increased visibility, safely and fall prevention.

Figure 13:
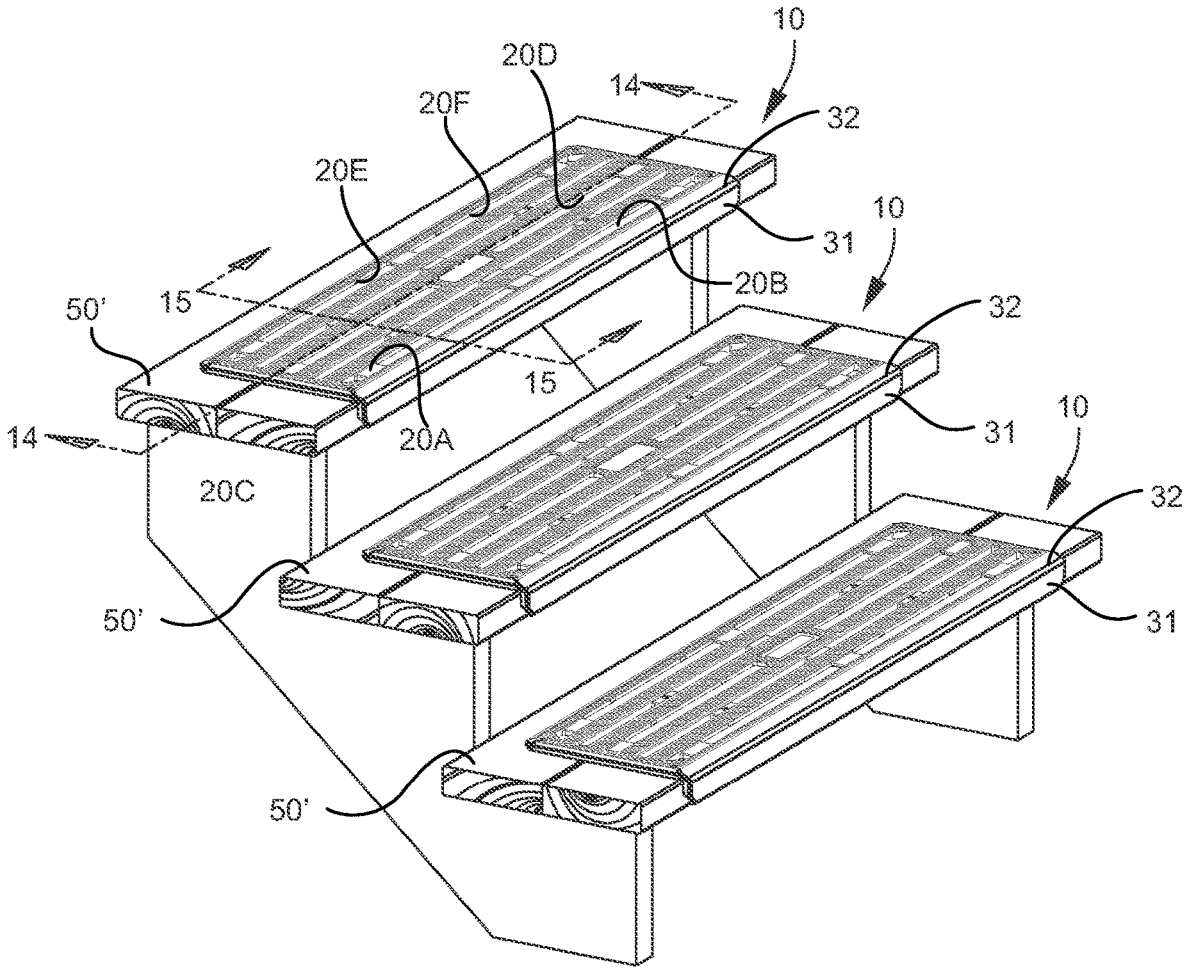
FIG. 13 is a perspective view of exemplary traction panel assemblies applied respective stair treads of wood staircase, and showing the assemblies without spiked inserts.
Figure 14:
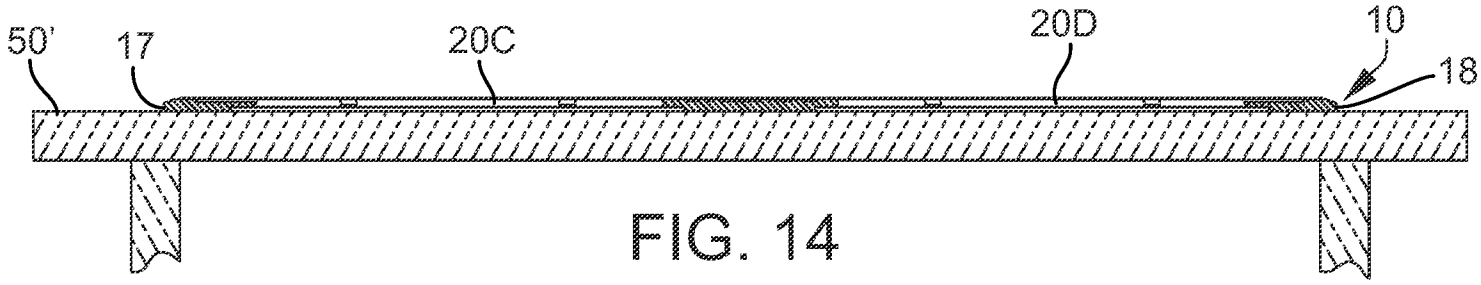
FIG. 14 is a cross-sectional view taken substantially along line 14-14 of FIG. 13.
Figure 15:
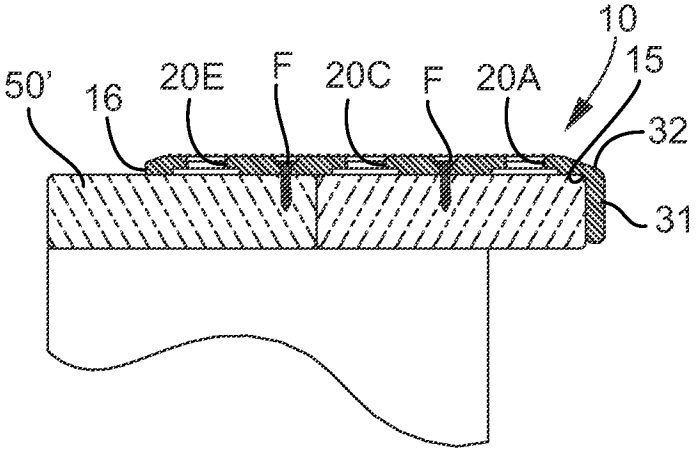
FIG. 15 is a further cross-sectional view taken substantially along line 15-15 of FIG. 13.

In an alternative application illustrated in FIGS. 13, 14, and 15, the exemplary traction panel assembly 10 may be applied to a stair tread 50' (or other underlying surface) without the spiked inserts 40. This arrangement may be especially desirable in warm weather months when less textured foot traction may be required to safely traverse stairs, steps, or walkways. In further alternative embodiment, the spiked inserts 40 may be added to and removed from slots 20 of the panel body 12 from the top surface 14 using a snap-in or other mechanical attachment means. In still further exemplary embodiments, the present traction panel assembly may incorporate a light package comprising a solar panel insert, a battery pack insert operatively connected to the solar panel insert, and an LED light insert operatively connected to one or both of the solar panel and battery pack inserts. The LED light insert may comprise 3-9 equally spaced LED lights. Using various sensors, the exemplary light package of the traction panel assembly may automatically emit a warm illuminating glow at night, and when motion is detected at or near the panel assembly, the LED lights may fully illuminate for a predetermined duration (e.g., 30 mins). Each of the solar panel, battery, and LED light inserts may comprise an elongated flat narrow base having a thin peripheral flange, such as previously described, and may be configured to closely fit within selected slots of the panel body.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A traction panel assembly for mounting on an underlying surface, comprising:

a panel body having an exposed top surface, opposing longitudinal sides, and opposing lateral ends, and defining a plurality of narrow substantially rectangular slots extending between said opposing sides and opposing ends; and a plurality of removable spiked inserts adapted for being custom arranged adjacent selected slots of said panel body, and each of said spiked inserts comprising an elongated substantially rectangular base having a base flange extending along a peripheral margin, wherein said base resides above said base flange and is adapted to fit within the selected slot of said panel body, and a series of spaced apart rigid spikes attached to said base and spaced inwardly from said base flange, said rigid spikes configured to extend vertically above the top surface of said panel body whereby said spiked insert is retained at said slot without direct attachment to the underlying surface.

2. The traction panel assembly according to claim 1, wherein said rigid spikes and elongated base of each spiked insert are integrally formed together as a single homogenous unit.

3. The traction panel assembly according to claim 1, wherein the series of spaced apart rigid spikes of each spiked insert comprises 3-8 rigid spikes.

4. The traction panel assembly according to claim 1, wherein each rigid spike has a forward-pointing, generally V-shaped tip configuration.

5. The traction panel assembly according to claim 1, wherein the plurality of narrow substantially rectangular slots of said panel body comprises 4-8 narrow slots extending between said opposing sides and opposing ends.

6. The traction panel assembly according to claim 5, wherein said plurality of removable spiked inserts comprises 4-8 removable spiked inserts adapted for being custom arranged within said 4-8 narrow slots of said panel body.

7. The traction panel assembly according to claim 1, wherein said panel body further defines a plurality of corner openings adapted for managing surface-water runoff.

8. The traction panel assembly according to claim 1, wherein said panel body has a low profile height of less than 0.5 inches.

9. The traction panel assembly according to claim 1, wherein said panel body has a chamfered front edge extending longitudinally between said opposing ends.

10. The traction panel assembly according to claim 9, and comprising a downwardly-turned lip formed along the front edge of said panel body.

11. The traction panel assembly according to claim 1, wherein a bottom of panel body comprises a plurality of integrally formed structural ribs.

12. The traction panel assembly according to claim 1, wherein the top surface of said panel body comprises an anti-slip surface texture.

13. The traction panel assembly according to claim 1, and comprising a plurality of fastener landings formed between adjacent slots of said panel body, and having respective holes for receiving fasteners used to mount said traction panel assembly to an underlying surface.

14. A traction panel assembly for mounting on an underlying surface, comprising:

a panel body having an exposed top surface, opposing longitudinal sides, and opposing lateral ends, and defining a plurality of narrow substantially rectangular slots extending between said opposing sides and opposing ends; and a plurality of removable spiked inserts adapted for being custom arranged adjacent selected narrow slots of said panel body, and each of said spiked inserts comprising an elongated flat narrow substantially rectangular base having a base flange extending along a peripheral margin and a series of spaced apart rigid spikes attached to said base and spaced inwardly from said base flange, and wherein said base resides above said base flange and is adapted to fit within the selected slot of said panel body, and wherein said base flange is adapted to reside beneath said panel body, such that said rigid spikes extend vertically upward through said slot and above the top surface of said panel body whereby said spiked insert is retained at said slot without direct attachment to the underlying surface.

15. The traction panel assembly according to claim 14, wherein the series of spaced apart rigid spikes of each spiked insert comprises 3-8 rigid spikes.

16. The traction panel assembly according to claim 14, wherein each rigid spike has a forward-pointing, generally V-shaped tip configuration.

17. The traction panel assembly according to claim 14, wherein the plurality of narrow substantially rectangular slots of said panel body comprises 4-8 narrow slots extending between said opposing sides and opposing ends.

18. The traction panel assembly according to claim 17, wherein said plurality of removable spiked inserts comprises 4-8 removable spiked inserts adapted for being custom arranged within said 4-8 narrow slots of said panel body.

19. The traction panel assembly according to claim 14, wherein said panel body has a chamfered front edge extending longitudinally between said opposing ends.

20. The traction panel assembly according to claim 14, wherein the top surface of said panel body comprises an anti-slip surface texture.

* * * * *